US005641090A

United States Patent [19]

Kowalski et al.

[11] Patent Number: 5,641,090

[45] Date of Patent: Jun. 24, 1997

[54] LID FOR REFUSE A CONTAINER

[75] Inventors: John A. Kowalski; Donald C. Presnell, both of Stephens City, Va.

[73] Assignee: Rubbermaid Commercial Products Inc., Winchester, Va.

[21] Appl. No.: 337,988

[22] Filed: Nov. 14, 1994

[51] Int. Cl.[6] ..... B65D 41/16

[52] U.S. Cl. ..... 220/782; 220/771; 220/784; 220/792; 220/793; 220/908; 206/508

[58] Field of Search ..... 220/212.5, 306, 220/326, 771, 908, 307, 355, 356, 357, 623, 780, 782, 784, 792, 793, 801, 802, 805; 206/508

[56] References Cited

U.S. PATENT DOCUMENTS

| | | | |
|---|---|---|---|
| D. 326,342 | 5/1992 | Doxey et al. . | |
| 2,907,491 | 10/1959 | Gunn . | |
| 3,140,007 | 7/1964 | Nettleship | 206/508 |
| 3,219,227 | 11/1965 | Deisner . | |
| 3,307,739 | 3/1967 | Cloyd et al. | 206/508 |
| 3,383,009 | 5/1968 | Weikert | 206/508 X |
| 3,419,184 | 12/1968 | Asenbauer | 206/508 |
| 3,759,416 | 9/1973 | Constantine . | |
| 4,111,329 | 9/1978 | Lampman . | |
| 4,267,700 | 5/1981 | Minter . | |
| 4,390,110 | 6/1983 | Pirro . | |
| 4,473,165 | 9/1984 | Lentjes . | |
| 4,673,087 | 6/1987 | Webb . | |
| 4,691,840 | 9/1987 | Ferbrache . | |
| 4,723,686 | 2/1988 | Pennisi . | |
| 4,819,827 | 4/1989 | DiSesa . | |
| 4,832,200 | 5/1989 | Deaton et al. . | |
| 4,848,580 | 7/1989 | Wise . | |
| 5,027,969 | 7/1991 | Lesquir | 220/270 |
| 5,085,340 | 2/1992 | Doxey et al. . | |
| 5,103,994 | 4/1992 | Doxey et al. . | |
| 5,111,954 | 5/1992 | Gaudreault | 220/266 |
| 5,183,180 | 2/1993 | Hawkins et al. . | |

FOREIGN PATENT DOCUMENTS

| | | | |
|---|---|---|---|
| 4214477 | 11/1993 | Germany | 206/508 |

OTHER PUBLICATIONS

Catalog page, Wastebasket lid; Sterilite Corporation, P. O. Box 524, Townsend, Massachusetts 01469. Publication date 1992.

P. 3, Refuse container lids; Continental Manufacturing Company, 123 Byassee Drive, Hazelwood, Missouri 63042. Published at least as early as Oct., 1994.

P. 2, Drums; Bergen Barrel & Drum Co., 43–45 O'Brien Street, Kearney, New Jersey 07032. Published at least as early as Oct., 1994.

*Primary Examiner*—Stephen K. Cronin

*Attorney, Agent, or Firm*—Renner, Kenner, Greive, Bobak, Taylor & Weber

[57] ABSTRACT

A lid 12 for refuse container and lid assembly having a base 14 and side walls 16 extending upwardly therefrom and terminating at an annular rim, the lid having a generally U shaped ledge 22 extending the approximate perimeter of the lid top portion 20 and elevated reinforcement means 36 and 38, and retaining members 70 intended to secure together the container and the lid 12.

17 Claims, 7 Drawing Sheets

LID FOR REFUSE A CONTAINER

BACKGROUND OF THE INVENTION

1. Field of the Invention

The subject invention relates generally to lids for refuse containers, and in particular to lids for refuse containers which may be selectively secured to the container.

2. The Prior Art

Refuse containers and lids have been well known in the sanitary maintenance applications. Typically such assemblies comprise a container and a lid. However often the container and lid assemblies do not include sufficient features to ensure that the lid remains secure to the container. When the assemblies transport medical waste it is imperative that the container and lid assemblies remain secured until it is desired to actually dispose of the contents of the container in a safe environment. Specifically, it is imperative that the container and lid do not become separated when the container or lid suffers an impact during the handling and transportation processes. Also, it is important the container and lid do not separate if the container falls off of or inside a vehicle transporting the assembly. Finally, it is important to ensure that the container and lid do not separate if the container is stacked on a like container, and the container subsequently falls from the bottom like container.

Various methods have been used to secure the container and lid during storage and transportation of the container and lid. For example, containers and lids may have apertures in their handles for receiving straps or ropes, which secure together the container and lid. However, this method of securement is very costly since the straps and ropes must be replaced after each use. In addition, a drop or impact often causes the straps or rope to break. Mechanical fasteners, such as screws and bolts, have also been used to secure together containers and lids. However, the use of these fasteners increases the time of processing and emptying the container. In addition, there is an increased expense in maintaining these additional mechanical fasteners.

SUMMARY OF THE INVENTION

The present invention overcomes the deficiencies of the refuse container and lid assemblies. The present unique design of a container and lid assembly provides for a lid which acts as a lid for a container, as well as a structural member to the container. Specifically, the inner dimensions of the ledge of the lid act to retain the outer dimensions of the container annular rim. Elevated reinforcing means such as rib members are oriented in specific orientations on the top portion of the lid. The rib members generally extend towards the generally C shaped ledge in the lid corners. The rib members act as a group of structural cells which resist deformation when force is applied to the container and lid. An additional reinforcing member may extend adjacent to the interior wall of the ledge, thereby providing additional stability and reinforcement to the lid. Retaining means, oriented adjacent to the exterior wall of the ledge, are positioned to underlie the container annular rim. The retaining means are dimensioned and positioned such that at least two adjacent retaining means must be simultaneously released to separate the container and lid assembly.

Accordingly, it is an objective of the present invention is to provide a lid for a refuse container having securing means for selectively securing the lid and container together.

A further objective of the present invention is to provide a lid for a refuse container having reinforcement means for assisting the lid in maintaining its shape and in preventing deformation of the lid during an impact.

Yet a further objective is to provide a container and lid assembly which may be used to safely transport medical waste material.

Another objective is to provide a lid for a refuse container which acts as a structural member of the container.

These and other objectives, which will be apparent to those skilled in the art, are achieved by a preferred embodiment which is described in detail below and which is illustrated by the accompanying drawings.

DESCRIPTION OF THE PREFERRED EMBODIMENT

Figure 1:
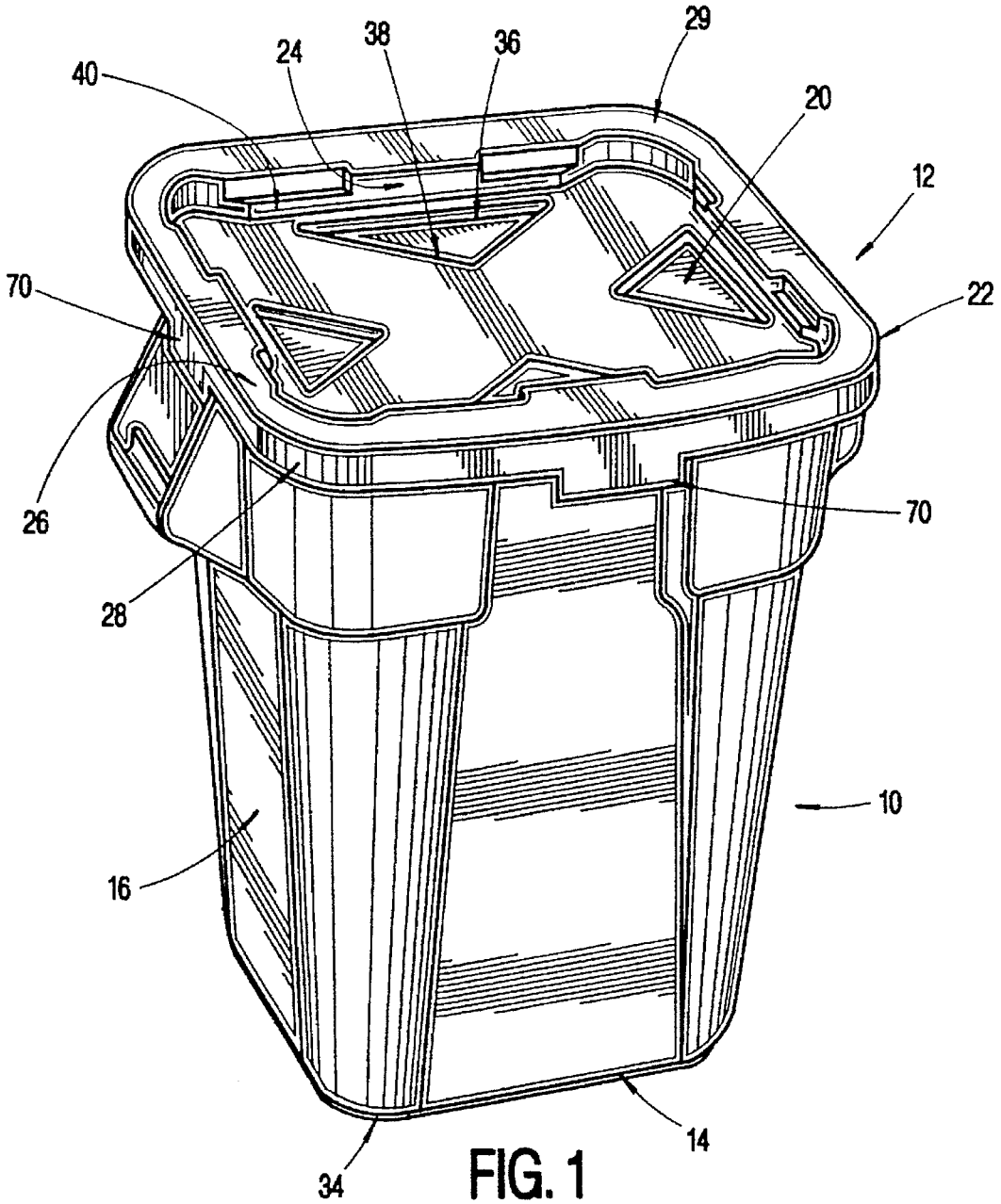
FIG. 1 is a front perspective view of the subject container and lid assembly.
Figure 2:
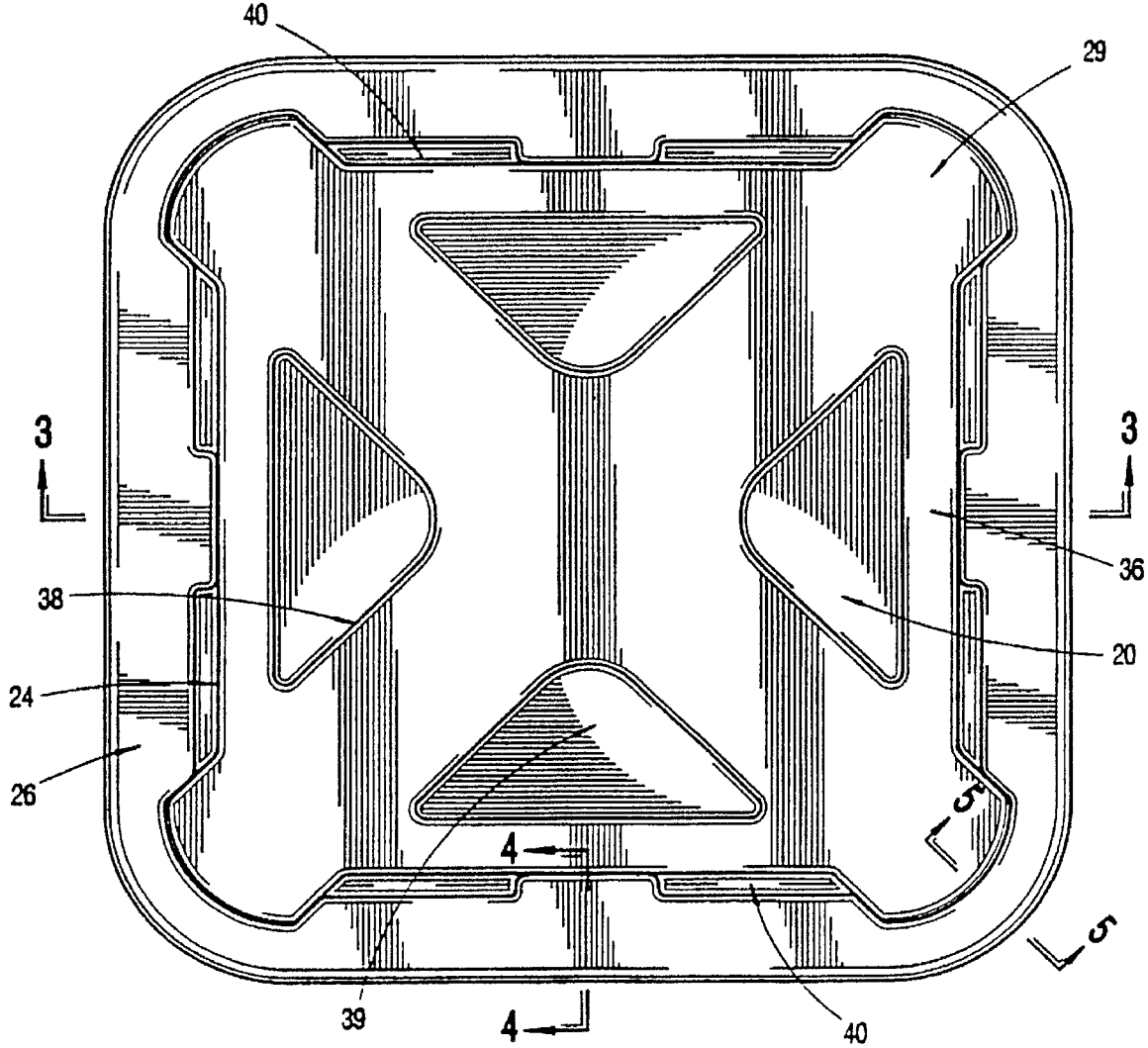
FIG. 2 is a top plan view of the subject container and lid assembly.
Figure 3:
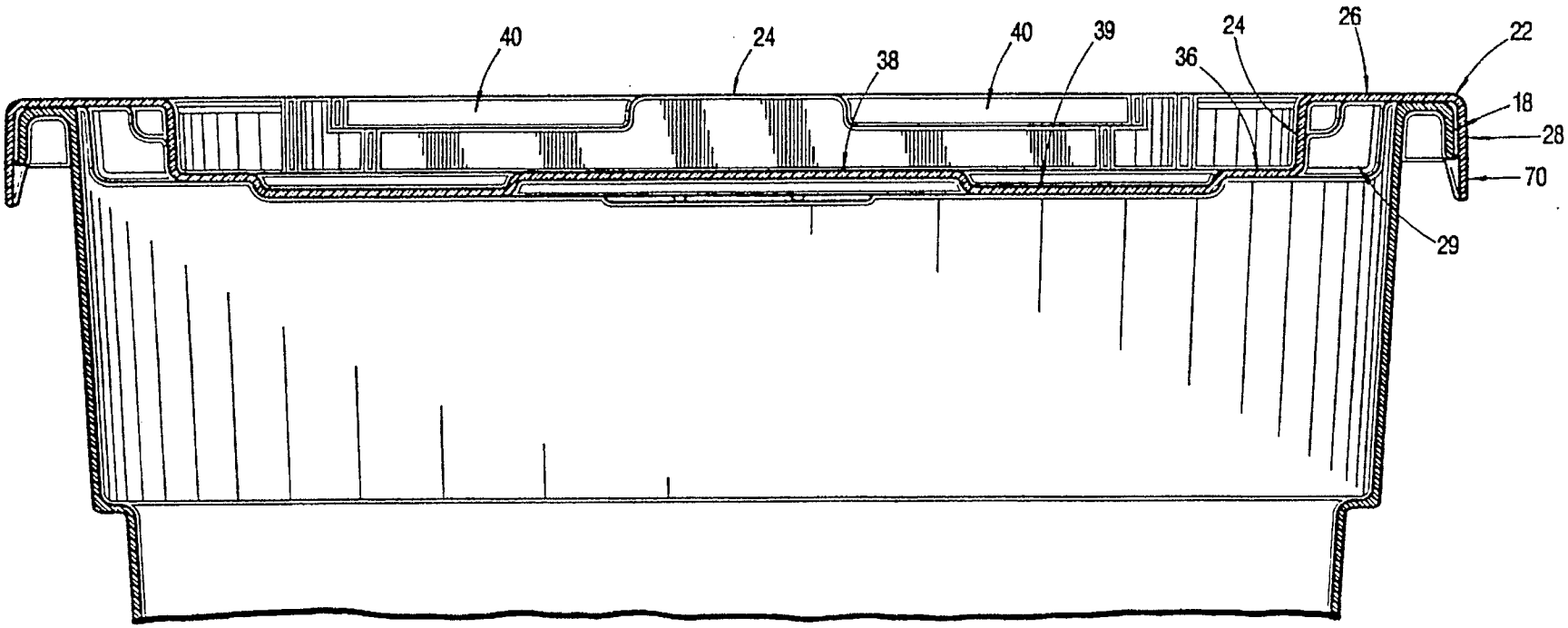
FIG. 3 is a cross sectional view of FIG. 2 along the lines 3—3.
Figure 4:
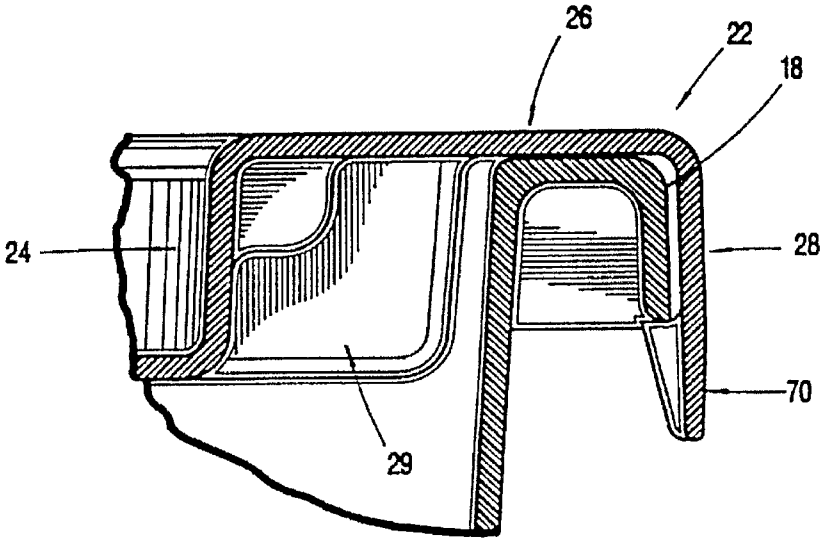
FIG. 4 is a cross sectional view of FIG. 2 along the lines 4—4.
Figure 5:
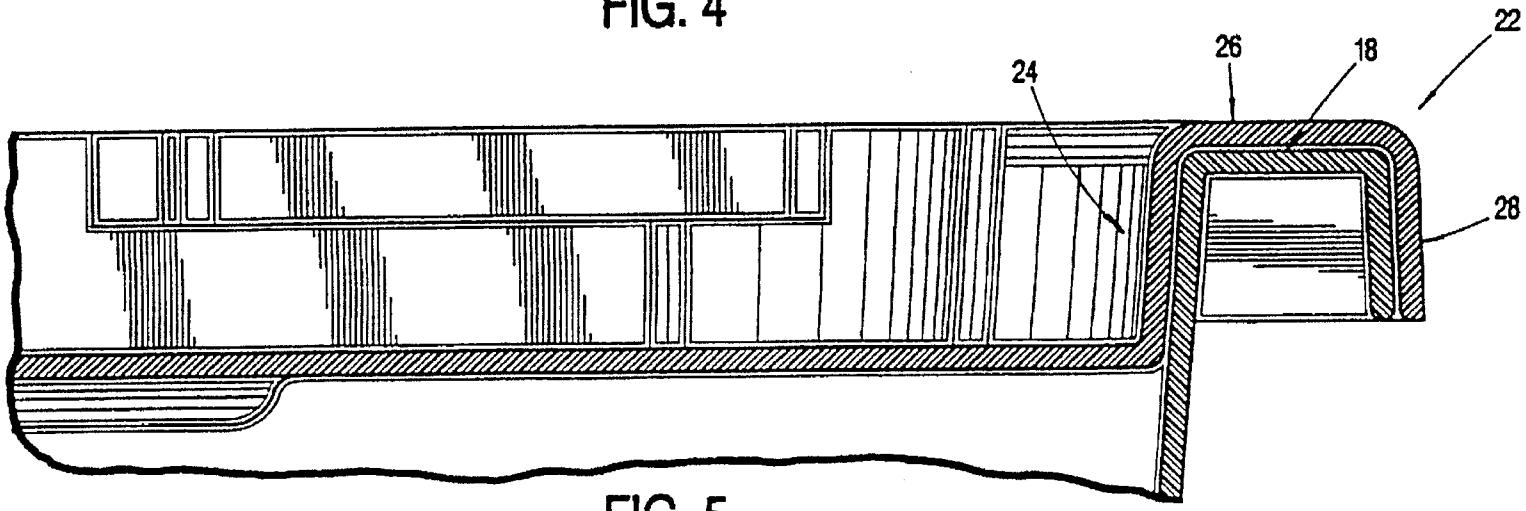
FIG. 5 is a cross sectional view of FIG. 2 along the lines 5—5.

With initial reference to FIGS. 1–3, the container and lid assembly is illustrated as comprising a container 10 having a generally square transverse sectional profile and a lid 12 having a generally square transverse sectional profile. FIG. 1 illustrates the container 10 including a base 14 which is generally square in shape and four side walls 16 extending in a generally upwardly direction from the base 14. The container 10 has an opening at the top of the side walls 16 defined by an annular rim 18, as clearly illustrated in FIGS. 3–5. As generally illustrated in FIGS. 1–3, the lid 12 includes a top closure portion 20, and a ledge 22 which surrounds the top closure portion 20. The ledge 22 extends the approximate perimeter of the top closure portion 20, and consists of an interior wall 24, top wall 26 and an exterior wall 28. Together the interior wall 24, top wall 26, and exterior wall 28 of the ledge 22 form a generally inverted U shape. As clearly illustrated in FIGS. 3–5, the internal dimensions of the ledge 22 interact with the outer dimensions of the container annular rim 18 such that the container annular rim 18 is snugly retained by the ledge 22, when the lid 12 and container 10 are secured together. FIGS. 3–5 clearly illustrate the container corners securely retained by the ledge 22, since generally the internal dimensions of the ledge 22 at the lid corners is less than the internal dimensions at any other location of the ledge 22. Specifically, the ledge is generally C shaped at the corners or includes C shaped recesses 29 in the lid corners are formed in the ledge 22 approximately adjacent to the interior 24 and top 26 walls in the lid corners. Therefore, the corners of the container annular rim 18 are closely confined by the corners of the lid 12, since the width of the top wall 26 is generally less in the corners than in any other location on the top wall 26, due to the ledge being generally C shaped 29 in the corners. As clearly illustrated in FIGS. 1–5, the close confinement of the container annular rim 18 by the ledge 22 at the lid corners, helps to ensure that the container 10 and lid 12 will remain secured and will not unintentionally become unsecured.

Figure 6:
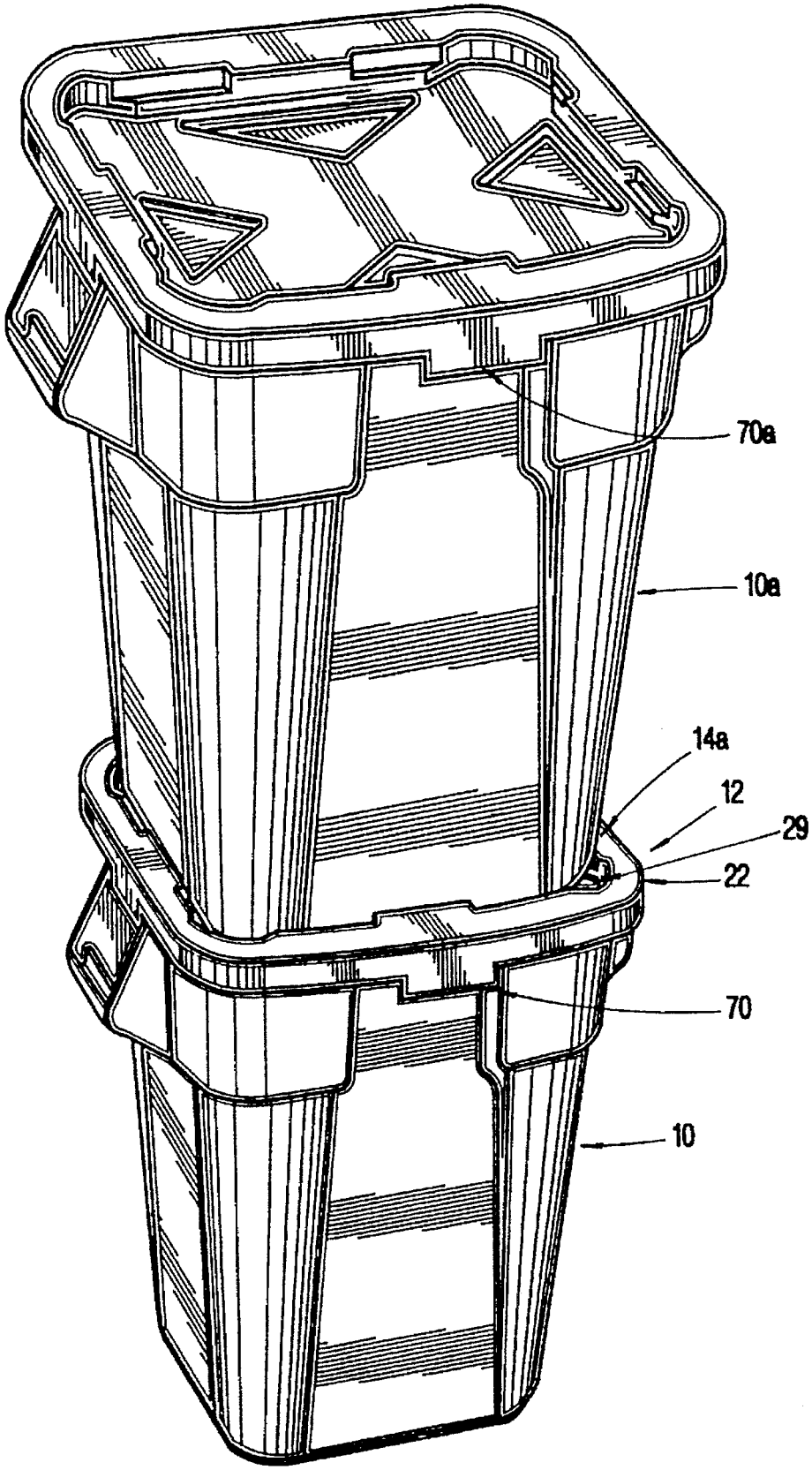
FIG. 6 is a perspective view of two stacked container and lid assemblies.

As illustrated in FIG. 6, the ledge 22 also assists in retaining a second like container 10A on top of a first secured container 10 and lid 12. Specifically, the base 14A of the second like container 10A will be retained by the ledge 22 on the first lid 12. The dimensions of the ledge 22 are sufficient to assist in preventing the second like container 10A from easily failing off of the first secured container 10 and lid 12. In addition, the ledge 22 assists in preventing horizontal movement of the secured like container 10A. Additionally as illustrated in FIG. 1, the underside of the base member 14 or 14A may include a rib member 34 which extends adjacent the perimeter of the base 14. The rib member assists in retaining a second like container 10A on top of a first secured container 10 and lid 12 assembly.

FIG. 2 illustrates a top plan view of the container lid 12 having elevated reinforcing means located on the top closure portion 20 of the lid 12. The reinforcing means consists of a continuous elevated rib member 36 extending adjacent the ledge interior wall 24. The elevation of the rib member 36 is approximately 30–40% of the elevation of the ledge 22. Additional reinforcing means may be oriented within the approximate center portion of the lid top portion 20. There are a variety of different orientations for the additional reinforcing means. FIG. 2 illustrates one of the orientations for the reinforcing means, wherein rib members 38 on the lid top portion 20 form a generally X shape, such that the rib members 38 generally intersect and cross in the approximate center of the lid top closure portion 20. The rib members 38 extend generally radially outward towards the lid corners. The rib members 38 extend into the approximate corners of the lid top portion 20. The elevation of the rib members 38 forming the generally X shape is approximately equal to the elevation of the rib member 36 approximately adjacent to the ledge interior wall 24. The rib members 38 and 36 form at least one generally triangularly shaped recess 39, and at least one generally triangularly shaped elevation on the lid top closure portion 20. Generally, the reinforcing means such as the rib members 36 & 38 assist in providing stability and rigidity to the lid 12, when the container 10 and lid 12 are secured together. In addition, the reinforcing means assist in preventing deformation to the container 10 and the lid 12 upon an impact, especially a corner impact. Also, the reinforcing means assist in securing the container 10 and lid 12 together.

The lid 12 may also contain at least one step portion 40 oriented within the ledge interior wall 24. For example FIGS. 1–2 illustrate two step portions oriented within the ledge interior wall 24 on each of the sides of the generally square shaped lid 12. As illustrated in FIGS. 1–2, the step portions 40 are approximately adjacent to the lid corners. The dimensions of the step portion 40, including the height and width, will vary depending upon many factors including but not limited to the dimensions of the container base 10 and lid 12, ledge 22 and rib members 36 and 38.

The step portions 40 provide additional reinforcement to the lid 12, and assist in preventing deformation to the secured container 10 and lid 12 upon impact.

Figure 7:
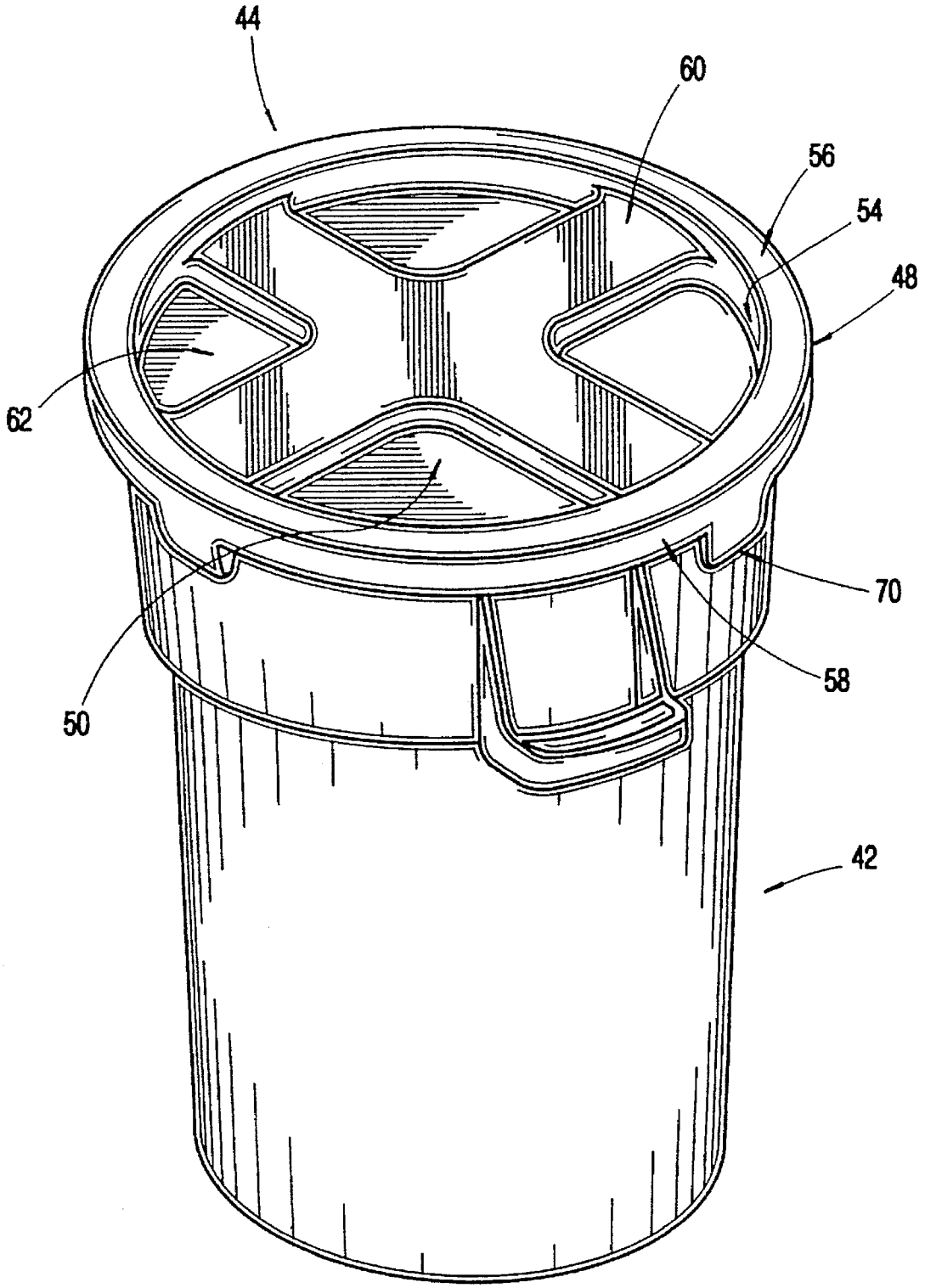
FIG. 7 is a perspective view of a second embodiment of a container and lid assembly.
Figure 8:
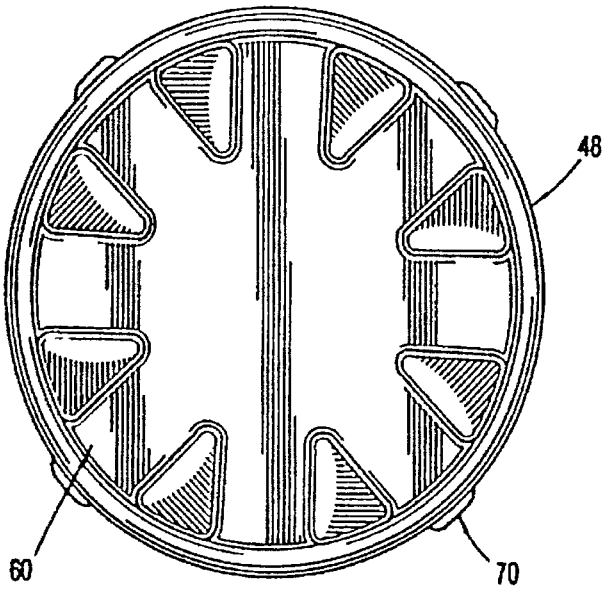
FIG. 8 is a top plan view of a third embodiment of a container and lid assembly.
Figure 9:
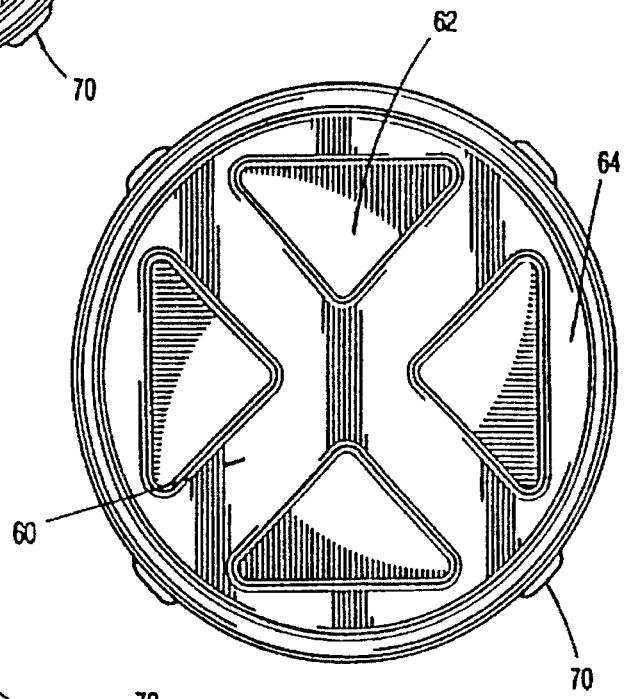
FIG. 9 is a top plan view of a fourth embodiment of a container and lid assembly.
Figure 10:
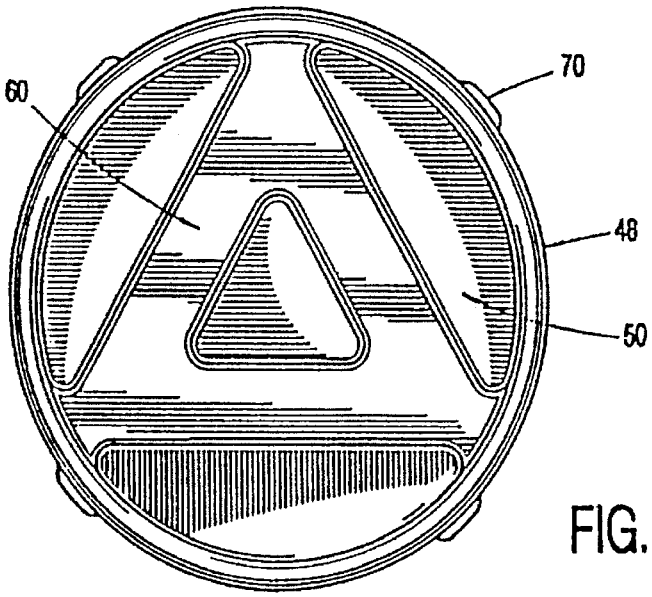
FIG. 10 is a top plan view of a fifth embodiment of a container and lid assembly.

As indicated earlier, the container 10 and lid 12 assemblies may be of a variety of sizes, shapes, and configurations. For example, FIG. 7 illustrates a container 42 and lid 44 assembly having a generally circular transverse sectional profile. FIGS. 8–10 illustrate additional embodiments of the lid 44 having a generally circular transverse sectional profile. Similarly to the container 10 illustrated in FIG. 1, the container 42 illustrated in FIG. 7 has an annular rim (not shown) at the upper portion of the wall 46. In addition, the lid 44 includes a ledge 48 surrounding the lid top closure portion 50. The ledge 48 includes an interior wall 54, top wall 56 and exterior wall 58. FIG. 7 illustrates an embodiment for a lid 44 having reinforcing means such as elevated rib members 60 forming a generally X shaped member oriented in the approximate center of the lid 44. The rib members 60 extend in an outwardly direction towards the ledge interior wall 54, and intersect the ledge interior wall 54. The elevated rib members 60 and the ledge 48 form generally triangularly shaped recesses 62 on the lid top closure portion 50.

FIG. 8 illustrates a second embodiment of the lid 44, wherein the elevated rib members 60 form a generally X shaped member and a generally spoke shaped member, such that the elevated rib members 60 all intersect in approximately the center portion of the lid top closure portion 50. The rib members 60 radiate from the center in a generally outwardly direction such that they intersect the ledge interior wall 54 at a variety of points. Additionally, the approximate center portion of the lid top closure portion 50 is generally elevated due to the intersection of the numerous rib members 60. The rib member 60 in the ledge interior wall 54 intersect to form numerous generally triangularly shaped recesses 62 on the lid top closure portion 50. Depending upon the size of the container 42 and lid 44 assembly, any number of rib members 60 can extend generally outwardly toward the ledge interior wall 54 from the approximate center of the lid 44.

A third embodiment for the generally circular lid 44 is illustrated in FIG. 9, wherein the elevated rib members 60 radiate generally outwardly from the approximate center of the lid top closure portion 50 and form a generally X shape. The elevated rib members 60 extend outwardly in a direction toward an elevated rib member 64 which is adjacent to the ledge interior wall 54. The elevation of the rib member 64 is approximately 50% of the elevation of the ledge 48. The elevation of the rib member 64 and elevation of the rib members 60 are approximately equal. Step portions (not shown) similar to the step portion 40 illustrated in FIG. 1, may also be located in the elevated reinforcing member 64 to provide additional reinforcement to the container 42 and lid 44 assembly. The elevated rib members 60 and the elevated rib member 64 interconnect to form a number of generally triangularly shaped recesses 62 on the lid top closure portion 50. These recesses 62 assist in providing the lid 44 and container 42 assembly with additional strength to prevent deformation upon impact.

A fourth embodiment of the lid 44 having a generally circular transverse sectional profile is illustrated in FIG. 10, wherein the elevated rib members 60 form a generally elevated triangular shaped member oriented within the approximate center of the lid top closure portion 50. The center of the triangularly shaped member is recessed.

The orientations of the rib members as illustrated in FIGS. 7–10 and described herein, can also be incorporated in the lid 12 having a generally square transverse sectional profile.

All the container and lid assemblies illustrated in FIGS. 1–10, may include retaining means for assisting in securing together the container and lid. The retaining means will be discussed herein with respect to the container 10 and lid 12 assembly as illustrated in FIGS. 1–6. However, the retaining means on the container 42 and lid 44 having generally circular transverse sectional profiles will be essentially the same as the retaining means located on the container 10 and lid 12 having a generally square transverse sectional profile. As illustrated in FIGS. 1–6, the retaining means are oriented on the bottom edge in the approximate center of the ledge exterior wall 28 on each side of the lid top closure portion 20. If the ledge interior wall 24 contains step portions 40, the retaining means is oriented between an approximate center of the step portions 40. The retaining means generally consist of a flange 70 which extends in a generally downwardly direction from the ledge exterior wall 28. The flange 70 has dimensions such that when the lid 12 is occupying a closed position on the container 10, the flange 70 underlies the bottom portion of the container annular rim 18, thereby enhancing the connection between the container 10 and the lid 12. Generally, the flanges 70 extend in a downwardly direction approximately 0.5 inches from the ledge exterior wall 28. The flange 70 is approximately 4 inches wide and has a depth of approximately 0.5 inch. However, the flanges 70 may be of a variety of dimensions depending upon the dimension of the lid 12 and container 10, and the dimensions of the rib members 36 and 38. Generally, the lid 12 having a square transverse sectional profile will have four flanges 70, with one flange 70 located on each lid side. Generally, the lid having a circular transverse sectional profile will have four flanges 70, each flange 70 separated from an adjacent flange 70 by approximately 90 degrees. However, the number of flanges 70 can vary depending upon a variety of factors including but not limited to the dimensions of the container 10, lid 12, and rib members 36 and 38. The flanges 70 act in combination with the reinforcement means 36 & 38 to ensure that the container 10 and lid 12 remain secured.

When the user desires to secure the lid 12 to the container 10, the user should exert a generally downwardly force on the lid 12 at locations on the lid 12 generally adjacent to the flanges 70. The user can then remove the lid 12 from the container 10 by simultaneously pulling in a generally outwardly direction on any two adjacent flanges 70. This motion allows the lid 12 to be easily removed and separated from the container 10. If only one flange 70 is pulled or if two non-adjacent flanges 70 are pulled in a generally outwardly direction, the combined force of the remaining flanges 70 and the reinforcing rib members 36 & 38 will prevent the lid 12 from being separated from the container 10. The requirement to simultaneously pull in a generally outwardly direction on two adjacent flanges 70 ensures that the lid 12 will not become unintentionally separated from the container 10.

While the aforementioned describes the preferred embodiment of the subject invention, the invention is not to be so restricted. Other embodiments, which will be apparent to one skilled in the art, and which utilize the teachings herein set forth, are intended to be within the scope and spirit of the present invention.

We claim:

1. A container and lid assembly, including a container comprising a base and four side walls extending upwardly therefrom and terminating at an upper annular rim, and a lid having a closed top portion and an inverted U shaped ledge extending along the periphery of said top portion, said ledge having an interior wall, an exterior wall, and a top wall, said ledge having an internal dimension cooperative with an external dimension of said container annular rim so as to snugly engage said container annular rim, said improvement comprising: first and second elevated reinforcement means, oriented on said lid top portion, for assisting in preventing deformation of said lid upon an impact, said first elevated reinforcement means disposed approximately adjacent the entire perimeter of said ledge interior wall and said second elevated reinforcement means being substantially X shaped and oriented centrally on said lid, said second elevated reinforcement means intersecting with said first elevated reinforcement means approximately adjacent to the corners of said lid, the height of said first and said second elevated reinforcement means being approximately equal, said ledge having substantially C shaped recesses formed in approximately said lid corners, such that the internal dimensions of said ledge in said corners are less than the internal dimensions of the remainder of said ledge.

2. A container and lid assembly according to claim 1, said lid further comprising at least one step oriented in a section of said ledge interior wall on each side of said lid.

3. A container and lid assembly according to claim 1, said lid further comprising two steps oriented in a section of said ledge interior wall on each side of said lid, said steps separated by a section of said ledge interior wall and at least one peripheral flange extending in a generally downwardly direction from said ledge exterior wall of each of said lid sides, said flange being disposed between said steps on each of said lid sides.

4. A container and lid assembly according to claim 1, said ledge assisting in stabilizing a second like container on said lid.

5. A container and lid assembly according to claim 1, said first and said second elevated reinforcement means forming at least one elevated triangularly shaped section on said lid top portion whereby the three sides of said triangularly shaped section are approximately equal.

6. A container and lid assembly according to claim 1, said lid further comprising at least two retaining means carried by said exterior wall of said ledge on each side of said lid, said retaining means positioned to underlie said annular rim when said container and said lid are secured together, said retaining means assisting in preventing said container and said lid from being separated unless two of said retaining means, which are oriented on adjacent sides of said lid, are simultaneously released from said annular rim.

7. A container and lid assembly according to claim 6, said retaining means comprising a peripheral flange extending in a substantially downward direction from said ledge exterior wall.

8. A container and lid assembly according to claim 7, said flanges preventing said lid from being separated from said container unless two adjacent flanges are simultaneously pulled in a substantially outward direction from said ledge exterior wall.

9. A container and lid assembly according to claim 7, said flanges preventing said lid from being separated from said container when at least two non adjacent flanges are positioned to underlie said container annular rim.

10. A container and lid assembly including a container comprising a base and four side walls extending upwardly therefrom and terminating at an upper annular rim, and a lid having a closed four sided top portion and an inverted U shaped ledge extending along the periphery of said four sided top portion, said ledge having an interior wall, an exterior wall, and a top wall, said ledge having an internal dimension cooperative with an external dimension of said container annular rim so as to snugly engage said container annular rim, said improvement comprising:

first and second elevated reinforcement means, oriented on said lid top portion, for assisting in preventing deformation of said lid upon an impact, said first elevated reinforcement means oriented adjacent said ledge interior wall end said second elevated reinforcement means being X shaped and oriented centrally on said lid, said second reinforcement means extending towards the corners of said lid, said ledge having C shaped recesses formed in approximately said lid corners, said first and second reinforcement means forming at least one triangularly shaped section on said lid top portion; said ledge interior wall further including two recesses disposed in each side of said ledge; at least one retaining means oriented adjacent said ledge exterior wall on each side of said lid and extending in a substantially downward direction from said ledge exterior wall, said retaining means positioned to underlie said annular rim when said container end said lid are secured together, said container and said lid being secured together until two adjacent retaining means are simultaneously released from said annular rim.

11. A container and lid assembly comprising a container having a base and an outer wall extending upwardly therefrom and terminating at an upper rim, and a lid having a closed top portion and an inverted U shaped peripheral ledge defining a wall of said top portion, said ledge having an interior wall, top wall, and an exterior wall, said ledge having dimensions cooperative with dimensions of said upper rim such that said upper rim is engaged by said ledge, the improvement comprising: said lid having elevated first reinforcement mean and a second reinforcement means said first reinforcement means oriented on said top portion for assisting in preventing deformation to said lid upon an impact, said first reinforcement means being elevated with respect to said top portion and said first reinforcement means extending in a substantially outward direction towards said ledge interior wall from a center of said lid top portion, and said second reinforcement means oriented adjacent said ledge interior wall and engaging said first reinforcement means interiorly of said ledge interior wall, the elevation of said first and second reinforcement means being approximately equal, said first reinforcement means further comprising first rib members forming a substantially X shape centrally oriented on said lid top portion, and second rib members forming a substantially spoke shape centrally oriented on said lid top portion, said first and second rib members extending in a substantially outward direction from said center of said lid top portion.

12. A container and lid assembly comprising a container having a base and an outer wall extending upwardly therefrom and terminating at an upper rim, and a lid having a closed top portion and an inverted U shaped peripheral ledge defining a wall of said top portion, said ledge having an interior wall, top wall, and an exterior wall, said ledge having dimensions cooperative with dimensions of said upper rim such that said upper rim is engaged by said ledge, the improvement comprising: said lid having elevated first reinforcement means and a second reinforcement means said first reinforcement means oriented on said top portion for assisting in preventing deformation to said lid upon an impact, said first reinforcement means being elevated with respect to said top portion and said first reinforcement means extending in a substantially outward direction towards said ledge interior wall from a center of said lid top portion, and said second reinforcement means oriented adjacent said ledge interior wall and engaging said first reinforcement means interiorly of said ledge interior wall, the elevation of said first and second reinforcement means being approximately equal, said lid further comprising at least three retaining means oriented adjacent said ledge exterior wall, said retaining means positioned to underlie said annular rim when said container and lid are secured together, said retaining means preventing said container and said lid from being separated unless two adjacent retaining means are simultaneously released from said annular rim.

13. A quadrilateral container comprising a bottom and four side walls extending upwardly therefrom and terminating at an upper rim, and a lid having a top portion surrounded by a U shaped ledge on a periphery of said top portion, said improvement comprising: said ledge having internal dimensions in the four corners which are substantially less than the internal dimensions of the remainder of said ledge such that the corners of said rim are more securely retained by said ledge corners than the remainder of said rim is retained by remainder of said ledge.

14. A quadrilateral container according to claim 13, said lid further comprising first reinforcing means, centrally oriented on said top portion, for reinforcing said lid.

15. A quadrilateral container according to claim 14, said first reinforcing means being substantially X shaped rib members extending towards said securing means.

16. A quadrilateral container according to claim 14, said lid further comprising second reinforcing means oriented adjacent an interior wall of said ledge, said first reinforcing means intersecting said second reinforcing means.

17. A quadrilateral container according to claim 16, said lid further comprising retaining means carried by an exterior wall of said ledge, said retaining means for securing together said container and said lid, at least one retaining means located on each side of said lid.

* * * * *